US011102572B2

(12) United States Patent
Kobayashi et al.

(10) Patent No.: US 11,102,572 B2
(45) Date of Patent: Aug. 24, 2021

(54) APPARATUS FOR DRAWING ATTENTION TO AN OBJECT, METHOD FOR DRAWING ATTENTION TO AN OBJECT, AND COMPUTER READABLE NON-TRANSITORY STORAGE MEDIUM

(71) Applicant: ASAHI KASEI KABUSHIKI KAISHA, Tokyo (JP)

(72) Inventors: Shiro Kobayashi, Menlo Park, CA (US); Masaya Yamashita, Tokyo (JP); Takeshi Ishii, Tokyo (JP); Soichi Mejima, New York, NY (US)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/370,600

(22) Filed: Mar. 29, 2019

(65) Prior Publication Data

US 2020/0314536 A1 Oct. 1, 2020

(51) Int. Cl.
*H04R 1/40* (2006.01)
*H04S 1/00* (2006.01)

(52) U.S. Cl.
CPC ..... *H04R 1/40* (2013.01); *H04S 1/00* (2013.01); *H04R 2201/40* (2013.01); *H04S 2400/11* (2013.01)

(58) Field of Classification Search
CPC ..... H04W 4/029; H04W 4/46; H04W 4/026; H04W 4/027; H04W 4/16; H04W 52/04; H04W 72/005; H04W 76/14; H04W 76/40; H04W 4/44; H04R 1/406; H04R 3/005; H04R 2430/01; H04R 3/00; A63F 13/213;

(Continued)

(56) References Cited

U.S. PATENT DOCUMENTS 6,933,930 B2 * 8/2005 Devige ..... G06F 3/0433 178/18.04
9,392,389 B2 * 7/2016 Hall ..... H04S 1/002

(Continued)

FOREIGN PATENT DOCUMENTS

JP H05150792 A 6/1993
JP 2009111833 A 5/2009

(Continued)

OTHER PUBLICATIONS

Jul. 7, 2020, International Search Report issued in the International Patent Application No. PCT/JP2020/014335.

*Primary Examiner* — Lun-See Lao
(74) *Attorney, Agent, or Firm* — Kenja IP Law PC

(57) ABSTRACT

An apparatus and a method for drawing attention to an object are provided. The apparatus includes an information acquisition unit configured to acquire personal information of a person, a processor that determines a target object based on the personal information and identifies positional information of the target object, and an emitter for emitting at least one of ultrasound waves and light to the target object based on the positional information. The method includes the steps of acquiring personal information of a person, determining the target object based on the personal information and identifying positional information of the target object, and emitting at least one of ultrasound waves and light from an emitter to the target object based on the positional information.

20 Claims, 6 Drawing Sheets

(58) Field of Classification Search
CPC ..... A63F 13/216; A63F 13/35; A63F 13/65; A63F 13/69; A63F 2300/1087; A63F 2300/205; H04M 2250/52; H04M 2250/62; H04M 3/436; H04M 19/04; H04M 1/0266; H04M 2250/12; H04M 7/003; H04M 7/0075; G10L 15/22; G10L 17/005; G10L 2015/088; G10L 25/63; G10L 13/00; G10L 13/027; G10L 13/10; G10L 15/00; G10L 15/24; G10L 15/26; G10L 15/265; G10L 15/30; G10L 17/02; G10L 17/22; G10L 17/24; G10L 2015/221; G10L 2015/223; G10L 2015/228; G10L 21/06; G10L 21/10; G10L 21/12; G10L 25/78
USPC ..... 381/92, 56–58
See application file for complete search history.

(56) References Cited

U.S. PATENT DOCUMENTS

| | | | | |
|---|---|---|---|---|
| 9,602,916 | B2 | 3/2017 | Asada | |
| 2006/0126918 | A1* | 6/2006 | Oohashi | G05D 1/0251 382/153 |
| 2009/0149991 | A1* | 6/2009 | Sumida | G06N 3/008 700/246 |
| 2013/0058503 | A1 | 3/2013 | Kato et al. | |
| 2015/0088641 | A1* | 3/2015 | Aoki | G06Q 30/0251 705/14.49 |
| 2015/0262103 | A1* | 9/2015 | Kim | H04B 10/116 705/14.58 |
| 2015/0346845 | A1 | 12/2015 | Di Censo et al. | |
| 2015/0379494 | A1 | 12/2015 | Noriyoshi et al. | |
| 2017/0329991 | A1* | 11/2017 | Van Dyne | G06F 21/6245 |
| 2018/0365695 | A1* | 12/2018 | Liu | G06Q 20/4014 |
| 2019/0311718 | A1* | 10/2019 | Huber | G06F 1/3231 |
| 2019/0313183 | A1* | 10/2019 | Saito | H04R 5/02 |
| 2020/0151765 | A1 | 5/2020 | Hiroaki et al. | |
| 2020/0226645 | A1 | 7/2020 | Takao et al. | |

FOREIGN PATENT DOCUMENTS

| | | | |
|---|---|---|---|
| JP | 2013057705 | A | 3/2013 |
| JP | 2013251751 | A | 12/2013 |
| JP | 2017191967 | A | 10/2017 |
| JP | 2018107678 | A | 7/2018 |
| WO | 2018016432 | A1 | 1/2018 |
| WO | 2019026361 | A1 | 2/2019 |
| WO | 2019059213 | A1 | 3/2019 |

* cited by examiner

*FIG.2*

| Target Object | Position Information |
|---|---|
| A | Pos_A |
| B | Pos_B |
| C | Pos_C |
| D | Pos_D |

APPARATUS FOR DRAWING ATTENTION TO AN OBJECT, METHOD FOR DRAWING ATTENTION TO AN OBJECT, AND COMPUTER READABLE NON-TRANSITORY STORAGE MEDIUM

TECHNICAL FIELD

The present disclosure relates to an apparatus for drawing attention to an object, a method for drawing attention to an object, and a computer readable non-transitory storage medium.

BACKGROUND

Directional speakers have been used in exhibitions, galleries, museums, and the like to provide audio information that is audible only to a person in a specific area. For example, U.S. Pat. No. 9,392,389 discloses a system for providing an audio notification containing personal information to a specific person via a directional speaker.

These conventional systems send general information to unspecific persons or specific information associated with a specific person from a fixed speaker.

SUMMARY

Retailers such as department stores, drug stores, and supermarkets often arrange similar products on long shelves separated by aisles. Shoppers walk through the aisles while searching products they need. Sales of the similar products depend greatly on the ability of the product to catch the shopper's eye and on product placement.

However, due to limitations of conventional product packaging, there has been demands for more effective ways to draw the shopper's attention to a specific product associated with the shopper's interest.

It is, therefore, an object of the present disclosure to provide an apparatus for drawing attention to an object, a method for drawing attention to an object, and a computer readable non-transitory storage medium, which can draw a person's attention to a specific target object based on the information obtained from the person.

In order to achieve the object, one aspect of the present disclosure is an apparatus for drawing attention to an object, comprising:

an information acquisition unit configured to acquire personal information of a person;

a processor that determines a target object based on the personal information and identifies positional information of the target object; and an emitter for emitting at least one of ultrasound waves and light to the target object based on the positional information.

Another aspect of the present disclosure is a method for drawing attention to an object, comprising:

acquiring personal information;

determining the target object based on the personal information and identifying positional information of the target object; and emitting at least one of ultrasound waves and light from an emitter to the target object based on the positional information.

Yet another aspect of the present disclosure is a computer readable non-transitory storage medium storing a program that, when executed by a computer, cause the computer to perform operations comprising:

acquiring personal information, determining a target object based on the personal information and identifying positional information of the target object;

emitting at least one of ultrasound waves and light from an emitter to the target object based on the positional information.

According to the attention-drawing apparatus, the attention-drawing method, and the computer-readable non-transitory storage medium of the present disclosure, it is possible to effectively draw a person's attention to a specific product associated with the personal interest.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 2 shows an example of a database table of the attention-drawing apparatus according to an embodiment of the present disclosure;

DETAILED DESCRIPTION

Figure 1:
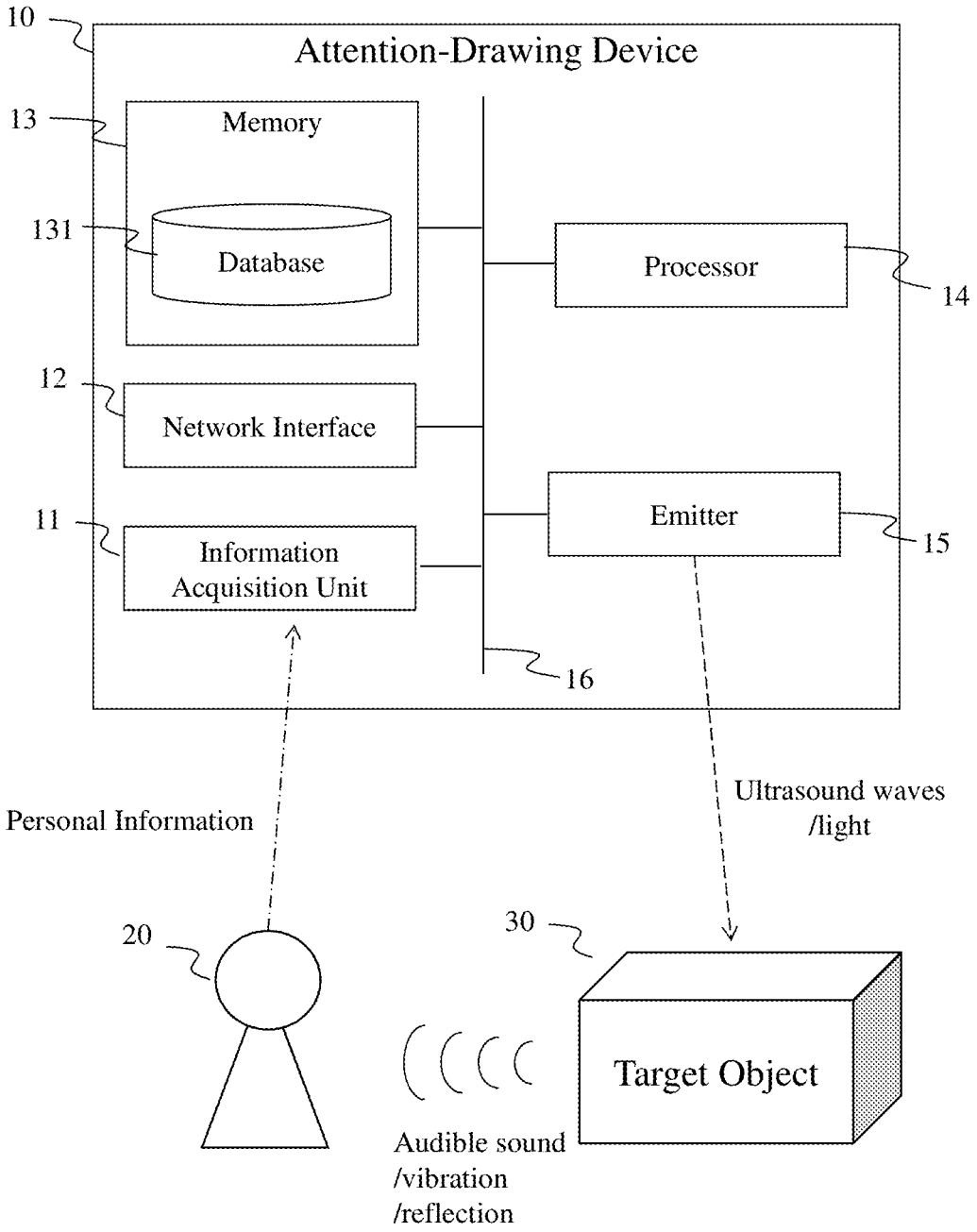
FIG. 1 is a schematic diagram of an apparatus for drawing attention to an object according to an embodiment of the present disclosure.

Embodiments will now be described with reference to the drawings. FIG. 1 is a block diagram of an apparatus 10 for drawing attention to an object according to an embodiment of the present disclosure.

The attention-drawing apparatus 10 is generally configured to acquire later-described personal information and determine a target object based on the personal information. The attention-drawing apparatus 10 then identifies positional information of the target object and emits ultrasound waves and/or light to the target object from an emitter 15 based on the identified positional information to highlight the target object. For example, when ultrasound waves are used, the target object is allowed to generate an audible sound to draw an attention of a person near the target object. When light is used, the target object is spotlighted to draw an attention of a person near the target object.

The target object may be any object including goods for sale such as food products, beverages, household products, clothes, cosmetics, home appliances, and medicines, and advertising materials such as signages, billboards and banners. When ultrasound waves are used, the target object is preferably able to generate an audible sound upon receiving the ultrasound waves. Each element of the attention-drawing apparatus 10 will be further discussed in detail below.

(Configuration of the Attention-Drawing Apparatus 10)

As shown in FIG. 1, the attention-drawing apparatus 10 includes an information acquisition unit 11, a network interface 12, a memory 13, a processor 14, and an emitter 15 which are electrically connected with each other via a bus 16.

The information acquisition unit 11 acquires personal information which is arbitrary information related to a person whose attention is to be drawn. The personal information may include, for example, still image information and video information (hereinafter comprehensively referred to as "image information") of the person or speech information uttered by the person. The information acquisition unit 11 is provided with one or more sensors capable of acquiring the personal information including, but not limited to, a camera and a microphone. The information acquisition unit 11 outputs the acquired personal information to the processor 14.

The network interface 12 includes a communication module that connects the attention-drawing apparatus 10 to a network. The network is not limited to a particular communication network and may include any communication network including, for example, a mobile communication network and the internet. The network interface 12 may include a communication module compatible with mobile communication standards such as 4th Generation (4G) and 5th Generation (5G). The communication network may be an ad hoc network, a local area network (LAN), a metropolitan area network (MAN), a wireless personal area network (WPAN), a public switched telephone network (PSTN), a terrestrial wireless network, an optical network, or any combination thereof.

The memory 13 includes, for example, a semiconductor memory, a magnetic memory, or an optical memory. The memory 13 is not particularly limited to these, and may include any of long-term storage, short-term storage, volatile, non-volatile and other memories. Further, the number of memory modules serving as the memory 13 and the type of medium on which information is stored are not limited. The memory may function as, for example, a main storage device, a supplemental storage device, or a cache memory. The memory 13 also stores any information used for the operation of the attention-drawing apparatus 10. For example, the memory 13 may store a system program and an application program. The information stored in the memory 13 may be updatable by, for example, information acquired from an external device by the network interface 12.

The memory 13 also stores a database 131. The database 131 includes a table containing target objects and their positional information. An example of the database 131 is shown in FIG. 2. In FIG. 2, each of the target objects A-D is associated with the records "Pos_A", "Pos_B", "Pos_C", and "Pos_D", respectively of the positional information. The positional information includes information required to specify the position coordinates of the target object. Alternatively, or additionally, the positional information may include information which can be used to adjust a direction of in which a beam of ultrasound waves or light is emitted by the emitter 15. Such information may include a distance between the emitter 15 and the target object, a relative position and/or a relative angle of the target object with respect to the position and attitude of the emitter 15. The processor 14 thus can look up the table of the database 131 and specify the position of the target object. The database 131 may be updated by, for example, information acquired from an external device via the network interface 12. For example, when the actual position of the target object has been changed, the processor 14 may update the positional information of the record associated with the target object to the information acquired from the external device via the network interface 12. Alternatively, the processor 14 may periodically acquire the positional information of the target object from the external device via the network interface 12 and update the positional information of each record based on the acquired information.

The processor 14 may be, but not limited to, a general-purpose processor or a dedicated processor specialized for a specific process. The processor 14 includes a microprocessor, a central processing unit (CPU), an application specific integrated circuit (ASIC), a digital signal processor (DSP), a programmable logic device (PLD), a field programmable gate array (FPGA), a controller, a microcontroller, and any combination thereof. The processor 14 controls the overall operation of the attention-drawing apparatus 10.

For example, the processor 14 determines the target object based on the personal information acquired by the information acquisition unit 11. Specifically, the processor 14 determines the target object in accordance with the personal information, for example, by the following procedure.

When the personal information includes image information obtained from an image of the person captured by an image sensor, the processor 14 determines the target object based on attribute information of the person extracted from the image information. The attribute information is any information representing the attributes of the person, and includes gender, age group, height, body type, hairstyle, clothes, emotion, belongings, head orientation, gaze direction, and the like of the person. The processor 14 may perform an image recognition processing on the image information to extract at least one type of the attribute information of the person. The processor 14 may also determine the target object based on plurality types of the attribute information obtained from image recognition processing. As the image recognition processing, various image recognition methods that have been proposed in the art may be used. For example, the processor 14 may analyze the image information by an image recognition method based on machine learning such as a neural network or deep learning. Data used in the image recognition processing may be stored in the memory 13. Alternatively, data used in the image recognition processing may be stored in a storage of an external device (hereinafter referred simply as the "external device") accessible via the network interface 12 of the attention-drawing apparatus 10.

The image recognition processing may be performed on the external device. Also, the determination of the target object may be performed on the external device. In these cases, the processor 14 transmits the image information to the external device via the network interface 12. The external device extracts the attribute information from the image information and determines the target object based on plurality types of the attribute information. Then, the attribute information and the information of the target object are transmitted from the external device to the processor 14 via the network interface 12.

In a case where the personal information includes the speech information uttered by the person, the processor 14 performs a speech recognition processing on the speech information to convert the speech information into text data, extracts a key term and determines a target object based on the extracted key term. The key term may be a word, a phrase, or a sentence. The processor 14 may use various conventional speech recognition methods. For example, the processor 14 may perform the speech recognition processing using the Hidden Markov Model (HMM), or the processor 14 may have been trained with using training data prior to performing the speech recognition processing. The dictionary and data used in the speech recognition processing may be stored in the memory 13. Alternatively, the dictionary and data used in the speech recognition processing may be stored in the external device accessible via the network interface 12. Various methods can be adopted for extracting the key term from text data. For example, the processor 14 may divide text data into morpheme units by morphological analysis, and may further analyze dependencies of the morpheme units by syntactic analysis. Then, the processor 14 may extract the key term from the speech information based on the results of the analyses.

The speech recognition processing may be performed on the external device. Also, the determination of the target object may be performed on the external device. In these cases, the processor 14 transmits the speech information to the external device via the network interface 12. The external device extracts the key term from the image information and determines the target object based on the key term. Then, the key term and the information of the target object are transmitted from the external device to the processor 14 via the network interface 12.

The processor 14 also identifies positional information of the determined target object. Specifically, the processor 14 looks up the database 131 stored in the memory 13 to find the record of the positional information associated with the target object. The processor 14 adjusts a beam direction of the emitter 15, which is a direction in which a beam of ultrasound waves or light is emitted by the emitter 15, based on the identified positional information of the target object to direct the sound waves/light from the emitter 15 to the target object.

The emitter 15 may be a directional speaker that emits ultrasound waves in a predetermined direction. When the target object is hit by the ultrasound waves, it reflects the ultrasound waves to generate an audible sound. The emitter 15 may be a directional speaker, which include an array of ultrasound transducers to implement a parametric array. The parametric array consists of a plurality of ultrasound transducers and amplitude-modulates the ultrasound waves based on the desired audible sound. Each transducer projects a narrow beam of modulated ultrasound waves at high energy level to substantially change the speed of sound in the air that it passes through. The air within the beam behaves nonlinearly and extracts the modulation signal from the ultrasound waves, resulting in the audible sound appearing from the surface of the target object which the beam strikes. This allows a beam of sound to be projected over a long distance and to be heard only within a limited area. The beam direction of the emitter 15 may be adjusted by controlling the parametric array and/or actuating the orientation/attitude of the emitter.

(Operation of the Attention-Drawing Apparatus 10)

Figure 3:
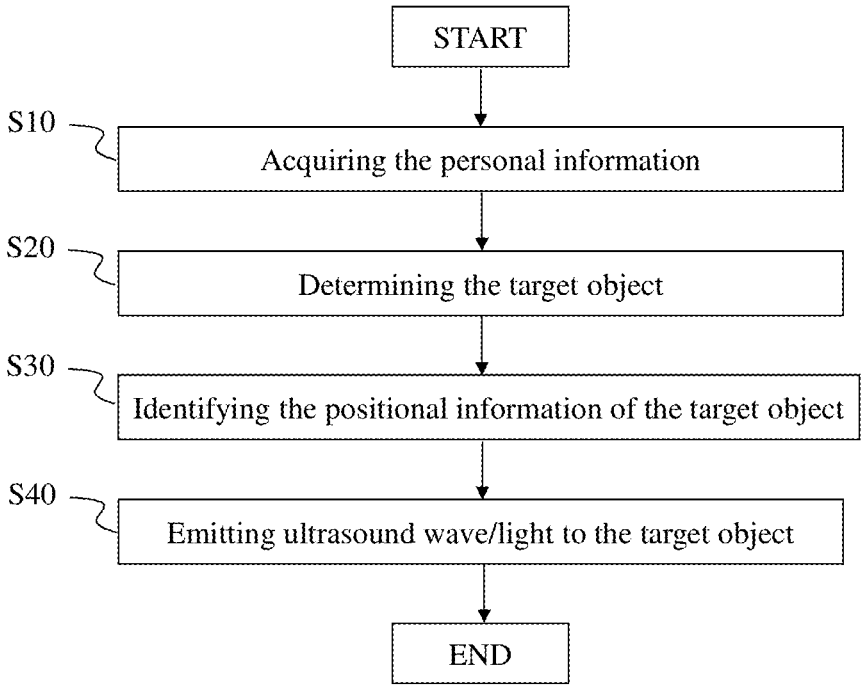
FIG. 3 is a flowchart showing steps in an operation of the attention-drawing apparatus according to an embodiment of the present disclosure.

Referring now to FIG. 3, the operation of the attention-drawing apparatus 10 will be discussed.

At the step S10, the information acquisition unit 11 acquires personal information and transmits the acquired personal information to the processor 14.

The processor 14 determines, at step S20, the target object based on the personal information received from the information acquisition unit 11.

Then, the processor 14 identifies the positional information of the target object at step S30. Specifically, the processor 14 looks up the database 131 stored in the memory 13 and retrieves the record of the positional information associated with the target object.

At step S40, the processor 14 adjusts the beam direction of the emitter 15 based on the positional information of the target object and sends a command to the emitter so as to emit a beam of ultrasound waves or light to the target object.

Upon being hit by the beam, the target object generates an audible sound, or is highlighted to be able to distinguish it from surrounding objects. In this way, the attention-drawing apparatus 10 according to the present disclosure can draw the person's attention to the target object.

Moreover, the attention-drawing apparatus 10 retrieves the positional information of the target object from the database 131, so that the exact location of the target object can be rapidly and easily identified.

Figure 4:
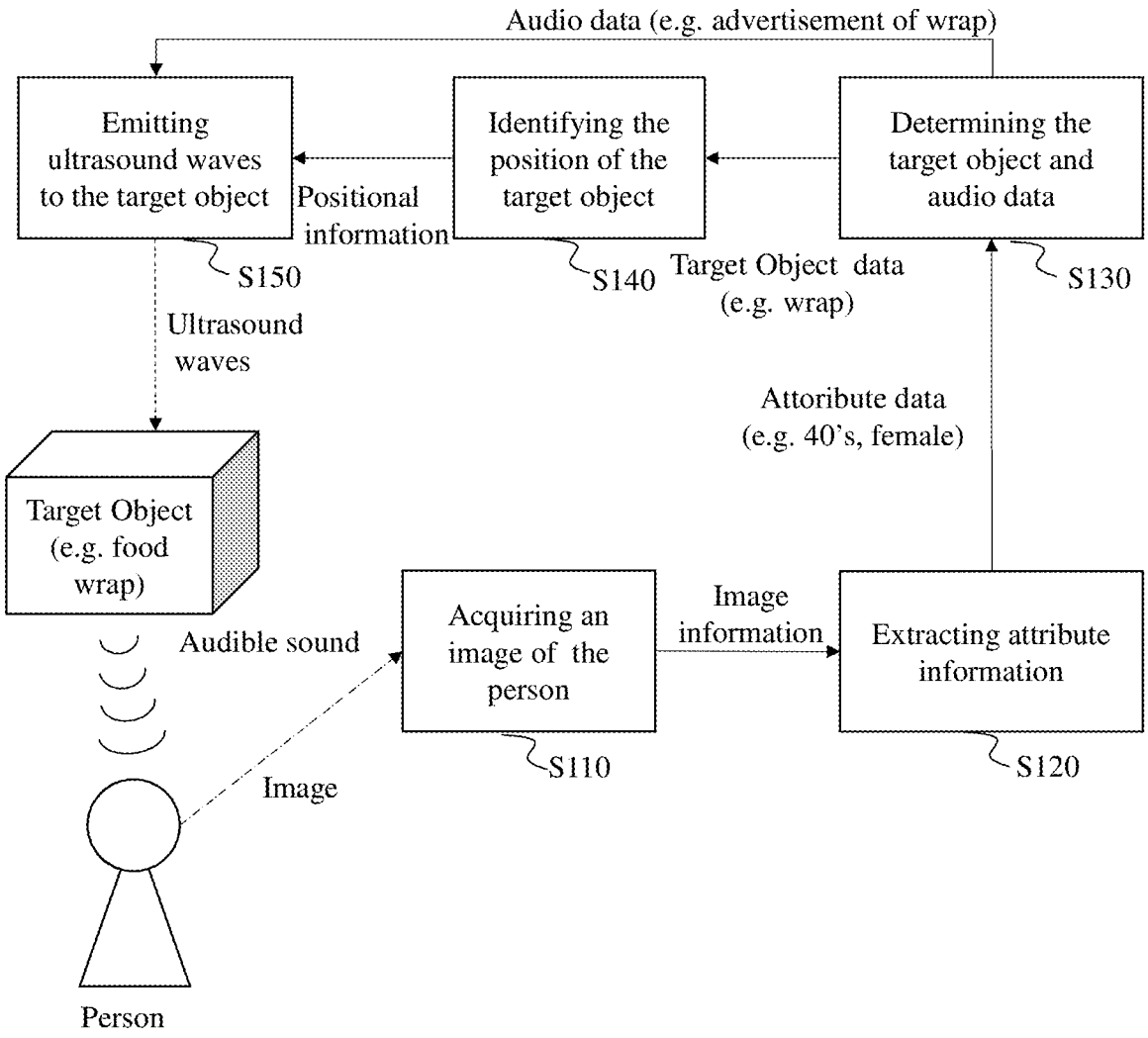
FIG. 4 is a diagram showing a general flow of an operation of the attention-drawing apparatus according to another embodiment of the present disclosure.

FIG. 4 is a diagram showing a general flow of an operation of another embodiment of the present disclosure. In this embodiment, the information acquisition unit 11 is a camera such as a 2D camera, a 3D camera, and an infrared camera, and captures an image of a person at a predetermined screen resolution and a predetermined frame rate. The captured image is transmitted to the processor 14 via the bus 16. The predetermined screen resolution is, for example, full high-definition (FHD; 1920*1080 pixels), but may be another resolution as long as the captured image is appropriate to the subsequent image recognition processing. The predetermined frame rate may be, but not limited to, 30 fps. The emitter 15 is a directional speaker projecting a narrow beam of modulated ultrasound waves.

At step S110, the camera 11 captures an image of a person as the image information and sends it to the processor 14.

The processor 14 extracts the attribute information of the person from the image information at step S120. The processor 14 may perform an image recognition processing on the image information to extract one or more types of the attribute information of the person. The attribute information may include an age group (e.g., 40*s*) and a gender (e.g., female).

At step S130, the processor 14 determines a target object based on the extracted one or more types of attribute information. For example, the processor 14 searches a product often bought by people belonging to the extracted attributes from the database 131. For example, when a food wrap is most often bought by people belonging to female in 40*s*, the processor 14 further retrieves audio data associated with the food wrap. The audio data may be a human voice explaining the detail of the product or a song used in a TV commercial of the product.

A single type of audio data may be prepared for each product. Alternatively, multiple types of audio data may be prepared for a single product and be selected based on the attribute information.

Then, the processor 14 identifies the positional information of the determined target object (food wrap) at step S140. Specifically, the processor 14 again looks up the database 131 to retrieve the record of the positional information for the target object. For example, the processor 14 identifies that the food wrap is placed on the shelf at Aisle X1, Bay Y1.

At step S150, the processor 14 adjusts the beam direction of the emitter 15 toward Aisle X1, Bay Y1. The audio data associated with the food wrap, the positional information of the food wrap and a command of emitting ultrasound waves are transmitted from the processor 14 to the emitter 15. The emitter 15 is activated by the command and emits the ultrasound waves to the food wrap to generate an audible sound from the food wrap.

The audible sound generated from the target product may draw the person's attention direct the person's eyes to the target product. The combination of visual and auditory information is more likely to motivate the person to buy the target product.

Figure 5:
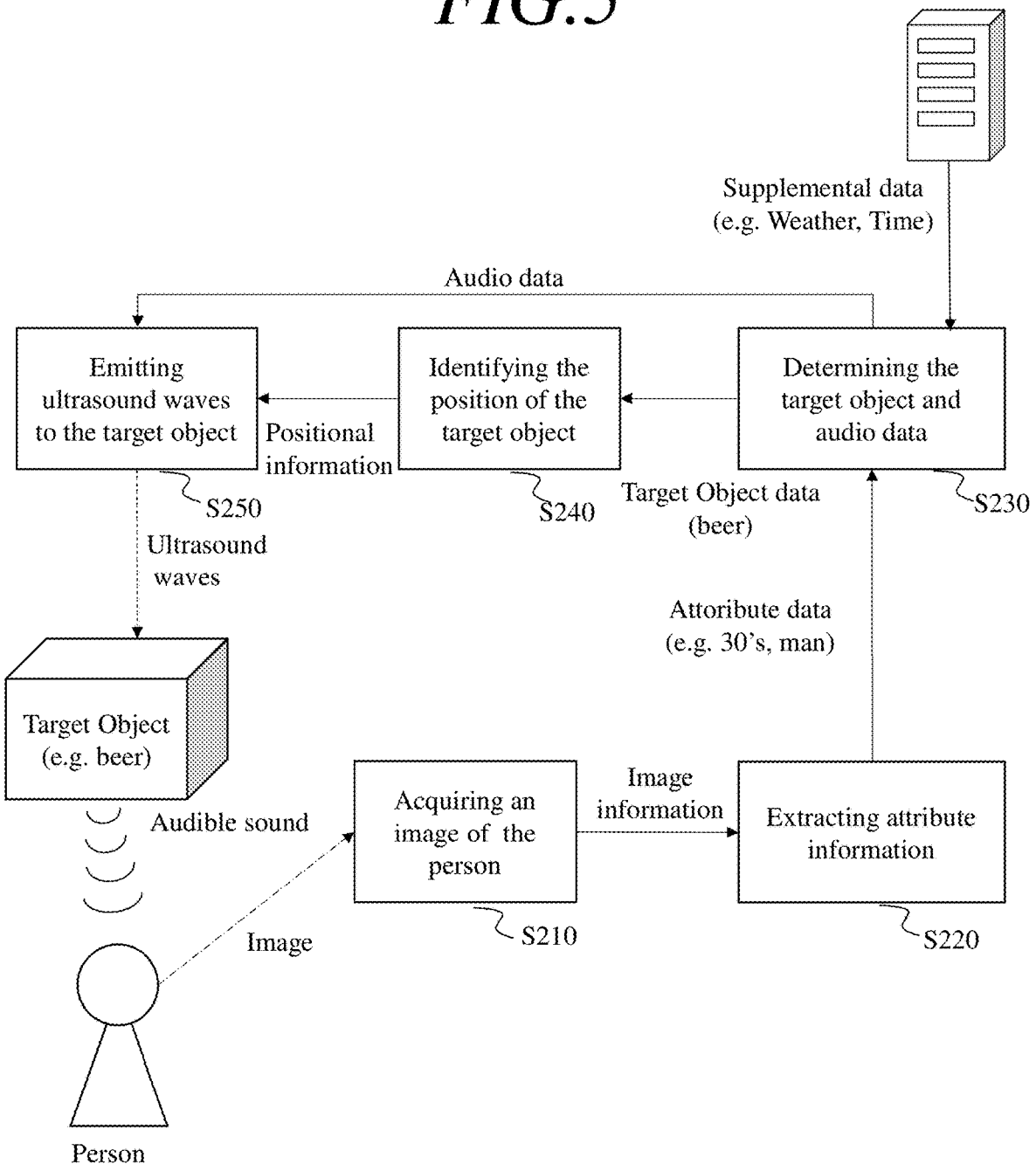
FIG. 5 is a diagram showing a general flow of an operation of the attention-drawing apparatus according to another embodiment of the present disclosure.

FIG. 5 is a diagram showing a general flow of an operation of another embodiment of the present disclosure. This embodiment is similar to the embodiment shown in FIG. 4 except that the attention-drawing apparatus 10 determines the target object using supplemental information from the external device. The processor 14 communicates with the external device via the network interface 12 to get the supplemental information. The supplemental information may be any information useful to determine the target object, such as weather condition, season, temperature, humidity, current time, product sale information, product price information, product inventory information, news information, and the like.

Steps S210 and S220 are similar to steps S110 and S120 as discussed above. In this case, the attributes of the person are "gender: male" and "age group: 30s". At step S230, the processor 14 determines a target object based on the extracted one or more types of the attribute information and further in view of the supplemental information. In this case, the supplemental information includes the weather condition and current time, which are, for example, "sunny" and "6 PM", respectively. Based on the attribute information (male in 30s) and the supplemental information (sunny at 6 PM) described above, the processor 14 determines the target object such as a beer. The processor 14 also retrieves audio data associated with a beer form the database 131 or the external device.

Then, the processor 14 identifies the positional information of the determined target object (beer) at step S240. Specifically, the processor 14 looks up the database 131 to retrieve the record of the positional information for the target object. For example, the processor 14 identifies that the beer is placed on the shelf at Aisle X2, Bay Y2.

At step S250, the processor 14 adjusts the beam direction of the emitter 15 toward Aisle X2, Bay Y2. The audio data associated with the beer, the positional information of the beer and a command of emitting ultrasound waves are transmitted from the processor 14 to the emitter 15. The emitter 15 is activated by the command and emits the ultrasound waves to the beer to generate an audible sound from the beer.

According to this embodiment, the information to be used for the determination of the target product (target object) can be dynamically modified, which may further enhance the person's motivation to buy the target product.

Figure 6:
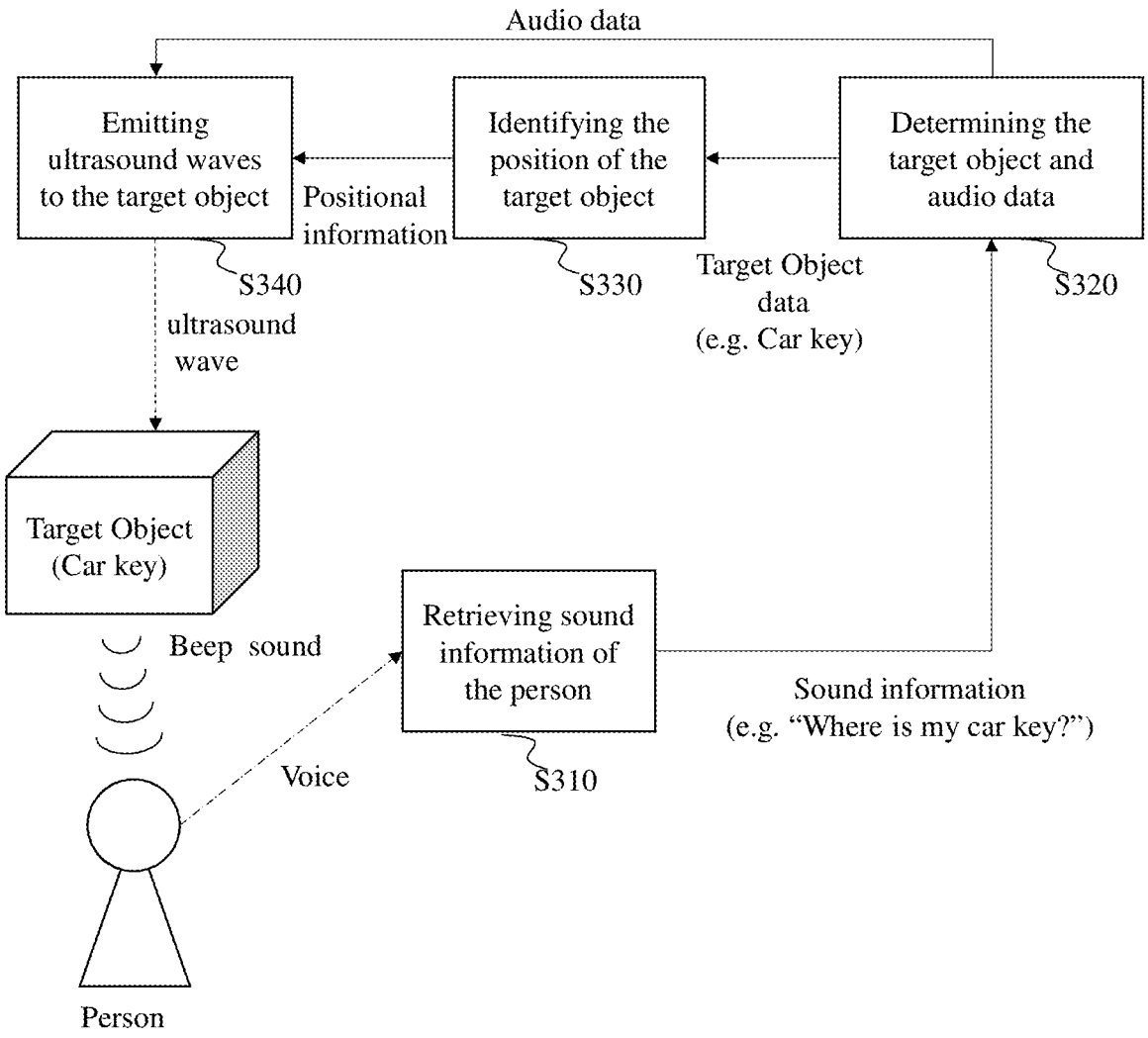
FIG. 6 is a diagram showing a general flow of an operation of the attention-drawing apparatus according to yet another embodiment of the present disclosure.

FIG. 6 is a diagram showing a general flow of an operation of yet another embodiment of the present disclosure. This embodiment is similar to the embodiment shown in FIG. 4 except that the information acquisition unit 11 is a microphone such as an omnidirectional microphone and a directional microphone.

At step S310, the microphone 11 picks up sounds or a voice from a person as the speech information and sends it to the processor 14. In this embodiment, a sentence "where is my car key" was uttered from the person.

The processor 14 extracts the attribute information of the person from the speech information at step S320. The processor 14 may perform a speech recognition processing on the speech information to convert the speech information into text data. The processor 14 may further extract a key term such as "car key" from the text data and determines a target object based on the extracted key term. Then, the processor 14 retrieves audio data associated with the target object from the database 131. The audio data may be, for example, a beep sound.

At step S330, the processor 14 identifies the positional information of the determined target object (car key). Specifically, the processor 14 looks up the database 131 stored in the memory 13 to retrieve the record of the positional information for the target object. For example, the processor 14 specifies that the positional information of the car key is on a dining table.

Based on the positional information, the processor 14 adjusts the beam direction of the emitter 15 toward the dining table. The audio data associated with the car key, the positional information of the car key and a command of emitting ultrasound waves are transmitted from the processor 14 to the emitter 15. The emitter 15 is activated by the command and emits the ultrasound waves to the dining table to generate the beep sound from the car key.

The beep sound generated from the target product may draw the person's attention direct the person's eyes to the object the person is looking for. In stead of, or in addition to the directional speaker, the emitter 15 may include a light emitting device such as a laser oscillator and illuminate the target object. This will increase the visibility of the target object and is more likely to draw the person's attention. When the emitter 15 includes a light emitting device, one or more actuated mirrors or prisms may be used to adjust the beam direction of the emitter 15.

The sound data used in this embodiment is a beep sound, but it is not particularly limited and may be human speech data of the name of the target object. Alternatively, the attention-drawing apparatus 10 further includes a text-to-speech synthesizer which converts the text data of the location information into human speech data.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution.

For example, the above-discussed embodiments may be stored in computer readable non-transitory storage medium as a series of operations or a program related to the operations that is executed by a computer system or other hardware capable of executing the program. The computer system as used herein includes a general-purpose computer, a personal computer, a dedicated computer, a workstation, a PCS (Personal Communications System), a mobile (cellular) telephone, a smart phone, an RFID receiver, a laptop computer, a tablet computer and any other programmable data processing device. In addition, the operations may be performed by a dedicated circuit implementing the program codes, a logic block or a program module executed by one or more processors, or the like. Moreover, the attention-drawing apparatus 10 including the network interface 12 has been described. However, the network interface 12 can be removed and the attention-drawing apparatus 10 may be configured as a standalone apparatus.

Furthermore, in addition to, or in place of sound and light, vibration may be used. In this case, the emitter may be, for example, an air injector capable of producing pulses of air pressure to puff air to the target object. When the target object is hit by the pulsed air, it vibrates to draw attention of a person.

The actual scope of the protection sought is intended to be defined in the following claims when viewed in their proper perspective based on the prior art.

The invention claimed is:

1. An apparatus for drawing attention of a person, comprising:

an information acquisition unit configured to acquire personal information of the person;

a processor that determines a target object to which the attention of the person is drawn based on the personal information and identifies positional information of the target object; and an emitter for emitting ultrasound waves to the target object based on the positional information to generate an audible sound from the target object, wherein the target object is different from the person.

2. The apparatus according to claim 1, wherein the information acquisition unit comprises a camera, the personal information includes image information of the person captured by the camera, and the processor extracts attribute information of the person from the image information and determines the target object based on the extracted attribute information.

3. The apparatus according to claim 1, wherein the information acquisition unit comprises a microphone, the personal information includes speech information uttered by the person and picked up by the microphone, and the processor extracts a key term from the speech information and determines the target object based on the extracted key term.

4. The apparatus according to claim 1, wherein the information acquisition unit comprises a camera and a microphone, the personal information includes image information of the person captured by the camera and speech information uttered by the person and picked up by the microphone, and the processor extracts attribute information of the person from the speech information and a key term from the speech information and determines the target object based on the extracted attribute information and the extracted key term.

5. The apparatus according to claim 1, further comprising a database including positional information of the target object, wherein the processor retrieves the positional information of the target object from the database.

6. The apparatus according to claim 1, further comprising a network interface, wherein the processor gets supplemental information via the network interface and determines the target object based on the personal information and the supplemental information.

7. The apparatus according to claim 1, further comprising a network interface, wherein the processor communicates with an external device via the network interface.

8. The apparatus according to claim 1, wherein the processor adjust a beam direction of the emitter based on the positional information of the target object.

9. The apparatus according to claim 1, wherein the emitter comprises a directional speaker that emits ultrasound waves in a predetermined direction.

10. The apparatus according to claim 1, wherein the emitter modulates the ultrasound waves based on the audible sound and projects a narrow beam of the modulated ultrasound waves.

11. A method for drawing attention of a person, comprising:

acquiring personal information of the person;

determining a target object to which the attention of the person is drawn based on the personal information and identifying positional information of the target object; and emitting ultrasound waves from an emitter to the target object based on the positional information to generate an audible sound from the target object, wherein the target object is different from the person.

12. The method according to claim 11, wherein the personal information includes image information of the person captured by a camera, and the method further comprises:

extracting attribute information of the person from the image information and determining the target object based on the extracted attribute information.

13. The method according to claim 11, wherein the personal information includes speech information uttered by the person and picked up by a microphone, and the method further comprises:

extracting a key term from the speech information and determining the target object based on the extracted key term.

14. The method according to claim 11, further comprising retrieving positional information of the target object from a database including the positional information of the target object.

15. The method according to claim 11, further comprising:

acquiring supplemental information via a network interface and determining the target object based on the personal information and the supplemental information.

16. The method according to claim 11, further comprising:

communicating with an external device via the network interface.

17. The method according to claim 11, further comprising:

adjust a beam direction of the emitter based on the positional information of the target object.

18. The method according to claim 11, wherein the emitter comprises a directional speaker that emits ultrasound waves in a predetermined direction.

19. The method according to claim 11, further comprising modulating the ultrasound waves based on the audible sound, and projecting a narrow beam of the modulated ultrasound waves from the emitter.

20. A computer readable non-transitory storage medium storing a program that, when executed by a computer, cause the computer to perform operations comprising:

acquiring personal information of a person, determining a target object to which an attention of the person is drawn based on the personal information and identifying positional information of the target object; and emitting ultrasound waves from an emitter to the target object based on the positional information to generate an audible sound from the target object, wherein the target object is different from the person.

* * * * *